US008657118B2

(12) United States Patent
Fajardo et al.

(10) Patent No.: US 8,657,118 B2
(45) Date of Patent: Feb. 25, 2014

(54) COLLECTOR FOR THE FLOTATION OF CARBONATES

(75) Inventors: Marc Rocafull Fajardo, Barcelona (ES); Joan Antoni Riaza Martinez, Girona (ES); Miquel Mundo Blanc, Barcelona (ES); Hammou Oumimoun, Casablanca (MA); Moulay Brahim Jouti, Casablanca (MA); Jamal Maghnouj, Casablanca (MA)

(73) Assignees: Kao Corporation, S.A., Barbera del Valles-Barcelona (ES); Centre d'Etudes et de Recherches des phosphates mineraux (CERPHOS), Roches Noires-Casablanca (MA)

( * ) Notice: Subject to any disclaimer, the term of this patent is extended or adjusted under 35 U.S.C. 154(b) by 1043 days.

(21) Appl. No.: 12/312,842

(22) PCT Filed: Nov. 28, 2007

(86) PCT No.: PCT/EP2007/062915
§ 371 (c)(1),
(2), (4) Date: Oct. 19, 2009

(87) PCT Pub. No.: WO2008/065129
PCT Pub. Date: Jun. 5, 2008

(65) Prior Publication Data

US 2010/0065479 A1 Mar. 18, 2010

(30) Foreign Application Priority Data

Nov. 29, 2006 (ES) ..... 200603059

(51) Int. Cl.
*B03D 1/014* (2006.01)
*B03D 1/02* (2006.01)

(52) U.S. Cl.
USPC ..... 209/166; 252/61

(58) Field of Classification Search
USPC ..... 252/61; 209/166
See application file for complete search history.

(56) References Cited

U.S. PATENT DOCUMENTS 3,297,098 A * 1/1967 Elman et al. ..... 175/69
3,963,628 A * 6/1976 Park ..... 252/8.84
4,324,653 A 4/1982 Henchiri et al.
4,425,229 A 1/1984 Baron et al.
4,514,290 A 4/1985 Swiatkowski et al.
4,790,931 A 12/1988 Koester et al.

FOREIGN PATENT DOCUMENTS

DE 4010279 A1 10/1991
FR 12529475 1/1982
GB 1451194 * 9/1976
SU 1645024 A1 4/1991

OTHER PUBLICATIONS

Luo, Z.J. and Xin, Q., "Development Trends of Flotation Collectors for Phosophorus Ores", Yunnan Metallurgy, 1999, vol. 28, No. 2 (Sum 155), pp. 17-24 (including English Language translation).
International Search Report issued by the International Searching Authority (ISA/EP) on Feb. 26, 2008 in connection with International Application No. PCT/EP2007/062915.
International Preliminary Report on Patentability issued by the International Preliminary Examining Authority (IPEA/EP) on Mar. 10, 2009 in connection with International Application No. PCT/EP2007/062915.

* cited by examiner

*Primary Examiner* — Thomas M Lithgow
(74) *Attorney, Agent, or Firm* — Gary J. Gershik; Cooper & Dunham LLP

(57) ABSTRACT

The invention relates to a collector for the separation by flotation of carbonates contained in non-sulfurous minerals, particularly phosphoric rock, comprising at least one phosphoric ester of formula (I)

(I)

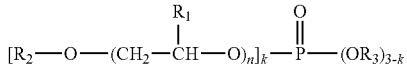

wherein, $R_1$ represents H, $CH_3$ or $C_2H_5$, $R_2$ represents a linear or branched alkyl or alkenyl group containing between 4 and 10 carbon atoms, $R_3$ represents H or a suitable cation, selected from an alkali metal, an alkaline earth metal, ammonium, alkyl ammonium, alkanol ammonium or glucammonium, k represents a number comprised between 1 and 2, and n represents a number comprised between 0 and 4.

18 Claims, No Drawings

COLLECTOR FOR THE FLOTATION OF CARBONATES

This application is a §371 national stage of PCT International Application No. PCT/EP2007/062915, filed Nov. 28, 2007, and claims priority of Spanish Patent Application No. P200603059, filed Nov. 29, 2006, the contents of all of which are hereby incorporated by reference into this application.

FIELD OF THE ART

The present invention relates to a collector for carbonate flotation comprising particular phosphoric esters. Said collector is especially suitable for the phosphoric rock flotation process.

PRIOR STATE OF THE ART

Fertilizers are natural or industrialized chemical products which are administered to plants for the purpose of optimizing their growth and the development of their genetic potential or profile; they are generally applied to the soil so that they are diluted in the solution and can be incorporated into the plant system through the roots; but they can also be applied through the stomata.

They provide the three main necessary nutrients for plant development in different proportions (nitrogen, phosphorus and potassium), secondary nutrients (calcium, sulfur and magnesium) and, sometimes micronutrients, which are also important for plant nutrition (boron, manganese, iron, zinc, copper and molybdenum).

Phosphoric rocks provide the main resource for producing phosphorated fertilizers and phosphatic chemicals. More than 75% of phosphoric rock resources have a marine origin, 10-15% have an igneous origin and only a small proportion is found in guano deposits.

Phosphoric rock deposits are widely distributed all over and throughout the world although the largest deposits are concentrated in North Africa and the Middle East (Morocco, Tunisia, Jordan) and also in the USA, China and Russia.

The most common phosphates are those of calcium of the apatite group ($Ca_5(PO_4)_3(F,Cl,OH)$). Other phosphates include minerals from the crandallite group as well as the variscite and strengite group, containing Al and Fe and corresponding to weathering environments (secondary phosphates), although apatite is the main source of phosphorus and phosphate for fertilizer production.

Typical phosphoric rock specifications for fertilizer production contain:

<1% MgO

>30% $P_2O_5$

<4% $SiO_2$

The main phosphate minerals of the apatite group are fluoroapatite, hydroxylapatite, carbonate-hydroxylapatite and francolite.

Flotation is a selection process that is generally used to prepare raw mineral products, in which the valuable minerals are separated from those without value. Examples of non-sulfurous minerals which are separated by flotation are for example apatite, fluorite, scheelite, calcite and other saline type minerals, cassiterite and other metal oxides, for example titanium and zirconium oxide as well as certain silicates and aluminosilicates.

The mineral, which can be dry ground, but preferably wet-ground, is previously crumbled and suspended in water for the flotation. Collectors are normally added to the mineral, frequently in combination with foaming agents and where appropriate, other auxiliary reagents such as regulators, depressors (deactivators) and/or enhancers (activators), to favor the separation of the valuable minerals from the unwanted mineral gangue components in the subsequent flotation. These reagents are usually allowed to act for a certain time on the finely ground (conditioned) mineral before insufflating air into the suspension (flotation) so as to generate a foam in its surface. In this case, the collector is in charge of causing a hydrophobization of the surface of the minerals such that these minerals are adhered to the gas bubbles formed during the air insufflation. The hydrophobization of the mineral components is carried out selectively such that the mineral components which are not to be floated are not adhered on the gas bubbles. The foam containing the mineral is separated and subsequently prepared. The object of the flotation is to obtain the valuable mineral from the minerals with the highest possible yield, and to simultaneously obtain, in this case, the best possible enrichment.

The separation of scarcely soluble minerals such as apatite, fluorite, scheelite, calcite and mineral silicates is a relatively simple process. However, the separation of these minerals from one another is difficult due to their similar surface chemical properties.

Due to the fact that most phosphate deposits in the world are deposits that also contain carbonates, the selective separation of phosphate minerals from carbonates (calcite, dolomite, etc.) is a process that has been intensively studied.

Non-ionic, anionic and cationic surfactants are used as collectors in known processes for the flotation of apatite, as described in "Sis, H., Chander, S. (2003) Reagents used in the flotation of phosphate ores: a critical review. Minerals Engineering, 16(7), 577-585, Elsevier Science Ltd."

Known anionic collectors are, for example, saturated and unsaturated fatty acids, especially tall oil and oleic acid fatty acids, phosphoric esters, especially optionally alkoxylated phosphoric esters derived from fatty alcohols or from fatty alcohol mixtures, alkyl sulfates, especially alkyl sulfates derived from fatty alcohols or from fatty alcohol mixtures, alkylaryl sulfonates, alkyl sulfosuccinates, alkylsulfosuccinimates and acyl lactylates.

Known cationic collectors are, for example, primary aliphatic amines, especially fatty amines derived from the fatty acids of vegetable and animal oils and fats, as well as certain alkyl-substituted and hydroxy alkyl-substituted alkylene diamines and the water-soluble acid additions salts of these amines.

Many collectors develop their own foam, suitable for flotation, due to their surfactant character. Nevertheless, it may also be necessary to develop the foam by means of special foaming agents or to suitably modify it. Known foaming agents for flotation are alcohols with 4 to 10 carbon atoms, polypropylene glycols, polyethylene glycol- or polypropylene glycol ethers, terpene oils (pine oils) and teresilic acids. In addition, the foam formed is occasionally excessive and too stable, which makes the flotation process in the flotation tanks difficult, because excess foam can be damaging during the subsequent step of forming phosphoric acid from the mineral. However, given that water is normally recirculated in the mineral flotation plant, the antifoaming agent can accumulate, affecting the flotation process.

Modifying reagents, for example, pH regulators, activators for the mineral to be obtained in the foam or deactivators for the unwanted minerals in the foam, and where appropriate, dispersants also, will be added to the suspensions to be floated insofar as is necessary.

In addition, the use of phosphoric esters and their ethoxylated derivatives for mineral (apatite and others) flotation is well known by persons skilled in the art. Thus, DE-A-1175623 describes a process for the flotation of non-sulfurous minerals, preferably phosphorite, apatite and/or iron oxides in which fatty alcohol phosphoric ester salts are used as anionic collectors. However, due to the fact that the foam generated by said phosphoric esters is not satisfactory, foaming agents (Flotanol F, polypropylene glycol alkyl ether) are required for an optimal flotation. DE-A-1175623 does not describe the type of carbonated chain of said phosphoric esters more specifically.

U.S. Pat. No. 4,324,653 describes a process for the treatment by means of direct flotation of phosphate minerals containing silico-carbonates as impurities, which process comprises the steps of a) overall flotation of the mineral, using a collector essentially comprising a phosphoric ester in an amount and under conditions capable of causing the silicates to be collected in the flotation concentrate, said flotation step being carried out at the natural pH of the mineral pulp (approximately 7.8), and recovering the float product containing the phosphate and the carbonate,
b) conditioning the float product in a phosphoric acid-free acid medium for a length of time sufficient to cause the flotation of the carbonates, while the phosphates remain in the flotation concentrate.

The process described in U.S. Pat. No. 4,324,653 mentions $C_8$-$C_{20}$ alkyl phosphate type phosphoric esters as suitable collectors, ethoxylated alcohol-derived phosphoric esters including from 4 to 12 moles of ethylene oxide being preferable.

U.S. Pat. No. 4,425,229 describes a process for the treatment by means of reverse flotation of phosphate minerals containing carbonates or silico-carbonates as impurities, said process comprises the steps of a) forming a suspension and conditioning said suspension with a depressor (sodium fluosilicate, etc.) to inhibit the flotation of the phosphates contained in the mineral,
b) treating the suspension conditioned in the previous step with a collector comprising a phosphoric ester in an amount sufficient to cause the flotation of the carbonates, and
c) separating by flotation the carbonates contained in the suspension and separating from said suspension the flotation concentrate containing the phosphates.

The process described in U.S. Pat. No. 4,425,229 mentions $C_8$-$C_{20}$ alkyl phosphate type phosphoric esters as suitable collectors, ethoxylated $C_{10}$-$C_{15}$ alcohol-derived phosphoric esters including from 4 to 12 moles of ethylene oxide being preferable.

U.S. Pat. No. 4,514,290 describes a process for the treatment by means of flotation of apatite, scheelite, magnesite, baryte, calcite or fluorite (fluospar) containing calcium, barium, or magnesium from silica, silicates or iron mineral impurities, said process comprising the steps of 1) forming a pulp of the mineral,
2) treating said pulp with an effective amount of a collector composition comprising a combination of
   a) 5-85% by weight of a fatty acid or a salt thereof,
   b) 10-75% by weight of an amidocarboxylic acid or an amidosulfonic acid, or a salt thereof, and
   c) 3-40% by weight of a partial ester of a phosphoric acid and at least one alkoxylated alcohol, and
3) separating the apatite, scheelite, magnesite, baryte, calcite or fluorite (fluorspar) from the calcium, barium or magnesium impurities by flotation at a pH above 6, collecting the flotation products and separating the flotation concentrate containing the impurities. The examples of U.S. Pat. No. 4,514,290 describe
   a) a mixture of monoester and diester of phosphoric acid and stearic alcohol, containing 4 moles of ethylene oxide per mole of alcohol
   b) a mixture of 45% monoester and 55% diester of phosphoric acid and oleyl alcohol, containing 8 moles of ethylene oxide per mole of alcohol.

Finally, FR-A-2529475 describes a process for enriching phosphate mineral by means of flotation, said process comprises the following steps:

a) a first step during which the mineral is conditioned in the form of a concentrated or dilute pulp at alkaline pH for 15 seconds to 3 minutes with the aid of a collector consisting of an amine or ethermine carboxylate and/or of a phosphoric ester or a phosphoric ester mixture;
b) a second step during which the flotation of the silicates and/or carbonates is carried out, precipitating the phosphate in the flotation concentrate, and in the event that the gangue contains silicates and after the flotation of the carbonates,
c) a third step during which the phosphate present in the flotation concentrate is separated.

In addition, Baudet, G. and Save, M, in "Phosphoric esters as carbonate collectors in the flotation of sedimentary phosphate ores. Chapter 14 of *Beneficiation of Phosphates: Advances in Research and Practice* (1999), 163-185, published by the Society for Mining, Metallurgy, and Exploration (ISBN: 0873351789)", studied the use of ethoxylated phosphoric esters as collectors for carbonates in phosphate minerals using sulfuric acid or sodium fluorosilicate as depressors. According to the authors, when the hydrocarbon chain of the ethoxylated phosphoric esters has from 12 to 15 carbon atoms, the maximum collector power is observed with 9 to 10 units of ethylene oxide.

Despite that described in the state of the art, it can be concluded that improvements in the field of non-sulfurous mineral enrichment by flotation are still required, particularly, in the phosphoric rock flotation process, in which collectors for the separation by flotation of carbonates are used, which on one hand allow obtaining a good yield and suitable foam but, on the other hand, allow said foam to not be excessive and to break easily, thus preventing the use of antifoaming agents.

DESCRIPTION OF THE INVENTION

The present invention offers an efficient solution to the mentioned drawbacks of the state of the art, providing a collector for the separation by flotation of carbonates contained in non-sulfurous minerals, particularly phosphoric rock, preferably apatite, which collector comprises at least one phosphoric ester of formula (I)

$$[R_2-O-(CH_2-\overset{R_1}{\overset{|}{C}}H-O)_n]_k-\overset{O}{\overset{\|}{P}}-(OR_3)_{3-k} \quad (I)$$

wherein, $R_1$ represents H, $CH_3$ or $C_2H_5$, $R_2$ represents a linear or branched alkyl or alkenyl group containing between 4 and 10 carbon atoms, $R_3$ represents H or a suitable cation, selected from an alkali metal, an alkaline earth metal, ammonium, alkyl ammonium, alkanol ammonium or glucammonium, k represents a number comprised between 1 and 2, and n represents a number comprised between 0 and 4.

Said collector, on one hand, allows obtaining a better efficiency and suitable foam, compared to known collectors, but on the other hand, allows said foam to not be excessive and to break easily, thus preventing the use of anti-foaming agents.

The use of at least one phosphoric ester of formula (I) as it is defined in claims 1 to 8 on the separation by flotation of carbonates contained in phosphoric rock is also part of the object of the invention.

The use of a collector comprising at least one phosphoric ester of formula (I) for the separation by flotation of carbonates contained in phosphoric rock is also part of the object of the invention.

It is also part of the object of the invention, a process for the separation by flotation of carbonates contained in phosphoric rock, in which a collector comprising at least one phosphoric ester of formula (I) is used.

DETAILED DESCRIPTION OF THE INVENTION

Phosphoric esters are products that are well known in the art. They are usually obtained from the reaction of alcohols with phosphorus pentoxide, and both the products obtained and the mentioned reaction are known, it being possible to find more detailed information about them in the article published by O'Lenick et al. in Soap Cosmetics and Chemical Specialities, July 1986, pg. 26.

According to the invention, it is preferred that $R_1$ represents H or $CH_3$ in the phosphoric ester of general formula (I). Therefore, if the alcohols reacting with phosphorus pentoxide are alkoxylated, said alkoxylation is preferably carried out with ethylene oxide (EO), propylene oxide (PO), or mixtures thereof.

In addition, phosphoric esters of general formula (I), wherein n is a number comprised between 0 and less than 4, preferably between 0.5 and less than 4, more preferably between and 3.5, still more preferably between 1.5 and 3, are preferred.

Phosphoric esters of general formula (I), wherein $R_2$ represents a linear or branched alkyl or alkenyl group containing between 4 and 8 carbon atoms, preferably between 6 and 8 carbon atoms, are also preferred. It is especially preferred that $R_2$ is derived from n-hexanol, n-octanol, 2-ethylbutanol, 2-methylpentanol, 2-ethylhexanol, 2-methylheptanol or mixtures thereof, preferably 2-ethylbutanol, 2-methypentanol, 2-ethylhexanol, 2-methylheptanol or mixtures thereof.

Phosphoric esters of general formula (I), wherein $R_3$ represents hydrogen or an alkali metal, are also preferred. Phosphoric esters of general formula (I), wherein $R_3$ represents hydrogen, sodium or potassium, are especially preferred.

Finally, phosphoric esters of general formula (I) formed by a mixture of monoester and diester are preferred. Particularly, the phosphoric esters of general formula (I) wherein the by weight ratio between monoester and diester is comprised between 90:10 and 50:50, preferably between 85:15 and 50:50, more preferably between 80:20 and 50:50, still more preferably between 80:20 and 60:40.

According to the invention, it is preferred that the collector according to the invention further comprises at least one cationic surfactant.

Optionally alkoxylated primary aliphatic amines; optionally alkoxylated linear or branched aliphatic polyamines; optionally alkoxylated aliphatic ether amines which can be obtained from the reaction of an optionally alkoxylated alcohol and acrylonitrile and the subsequent hydrogenation of the resulting nitrile ether; and the water-soluble acid addition salts of these amines and/or ether amines can be mentioned among suitable cationic surfactants. Primary aliphatic amines; alkylene diamines substituted with alpha-branched alkyl moieties; hydroxy alkyl-substituted alkylene diamines; aliphatic ether amines and the water-soluble acid addition salts of these amines are the cationic surfactants that are especially preferred.

Preferred acids for forming addition salts are hydrochloric, phosphoric, nitric, sulfuric, acetic and formic acid, or mixtures thereof. Preferably hydrochloric, phosphoric and acetic acid, or mixtures thereof.

The use of at least one phosphoric ester of formula (I) as it is defined in claims 1 to 8 in the separation by flotation of carbonates contained in phosphoric rock is also part of the object of the invention.

The use of a collector according to the invention for the separation by flotation of carbonates contained in phosphoric rock, preferably apatite, is also part of the object of the invention.

A process for the separation by flotation of carbonates contained in phosphoric rock, preferably apatite, is also part of the object of the invention, which process is characterized in that said ground phosphoric rock is mixed with water to form a suspension, air is introduced in the suspension in the presence of a collector and the foam formed is separated together with the carbonates contained therein, the phosphates remaining as a flotation concentrate, characterized in that a collector is used comprising at least one phosphoric ester of formula (I),

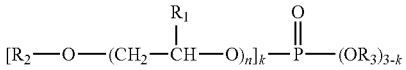

(I)

wherein, $R_1$ represents H, $CH_3$ or $C_2H_5$, preferably H or $CH_3$, $R_2$ represents a linear or branched alkyl or alkenyl group containing between 4 and 10 carbon atoms, preferably between 6 and 8 carbon atoms, $R_3$ represents H or a suitable cation, selected from an alkali metal, an alkaline earth metal, ammonium, alkyl ammonium, alkanol ammonium or glucammonium, preferably H or an alkali metal, still more preferably H, sodium or potassium.

k represents a number comprised between 1 and 2, and n represents a number comprised between 0 and 4, preferably between 0 and less than 4, more preferably between 0.5 and less than 4, still more preferably between 1 and 3.5, still more preferably between 1.5 and 3.

The content of phosphoric ester of formula (I) in the collector according to the invention is comprised between 5-95% by weight, preferably between 20-80% by weight, still more preferably between 35-65% by weight, with respect to the total weight of said collector.

According to the invention, it is preferred that the collector according to the invention further comprises at least one cationic surfactant of those described above. The separation of carbonates and silicates contained in the phosphoric rock is thus achieved in a single step, the phosphates remaining as a flotation concentrate.

The by weight ratio between the phosphoric esters of formula (I) and the cationic surfactant will depend on the composition of the phosphoric rock and, more specifically of its silicate and carbonate content.

It is preferred that the by weight ratio between the phosphoric esters of formula (I) and the cationic surfactant is comprised between 1:1 and 8:1, preferably between 2:1 and 5:1.

In addition, the cationic surfactant can also be separately added to the phosphoric ester of formula (I), thus having two collectors, one collector comprising at least one phosphoric ester of formula (I) and the other collector comprising at least one cationic surfactant of those described above. The separation of carbonates and silicates contained in the phosphoric rock is thus also achieved in a single step, the phosphates remaining as a flotation concentrate.

However, said cationic surfactant can also be added in a step that is independent from the separation of the carbonates, two steps thus being needed, one step for the separation of carbonates and the other step for the separation of the silicates contained in the phosphoric rock, the phosphates remaining as a flotation concentrate.

The collector according to the present invention will generally be used in amounts from 20 to 2000 g per ton of raw phosphoric rock, preferably from 50 to 1500 g per ton of raw phosphoric rock.

The collector according to the invention can additionally contain one or more of the following additives, this list not being limited; non-ionic surfactants, anionic surfactants and cationic surfactants, foaming agents, pH regulators, activators for the mineral to be obtained in the foam or deactivators for the unwanted minerals in the foam, dispersants, etc.

The following examples are set forth for the purpose of providing the person skilled in the art with a sufficiently clear and complete explanation of the present invention, but they must not be considered as limitations to the essential aspects of the object thereof, as they have been set forth in the previous sections of this description.

EXAMPLES

Example 1

Flotation Tests

Phosphoric rock (apatite) from Morocco with the following chemical composition, referred to the main components according to X-ray fluorescence (XRF), was used as the material to be floated:

| | |
|---|---|
| $P_2O_5$ | 28.20% |
| CaO | 48.89% |
| $SiO_2$ | 4.68% |
| MgO | 0.39% |

Said material was ground, the following granulometric distribution being obtained:

| Size (μm) | Weight (g) | % |
|---|---|---|
| 600 | 0.23 | 0.05 |
| 425 | 0.32 | 0.06 |
| 300 | 0.81 | 0.16 |
| 250 | 1.90 | 0.38 |
| 180 | 138.37 | 27.67 |
| 125 | 237.73 | 47.55 |
| 90 | 76.06 | 15.21 |
| 60 | 18.89 | 3.78 |
| 0 | 5.51 | 1.10 |

The flotation of the carbonates contained in the phosphoric rock (reverse flotation) was carried out to enrich the apatite, the phosphates being recovered in the flotation concentrate.

A Denver model D-10 laboratory flotation equipment was used. The tests were carried out in 1.5 L flotation cells at 1000 rpm. and at room temperature.

The mineral was conditioned for 2 minutes at 25% of solids and the flotation was also carried out at a solid concentration of 25%. The collector dose was 500 g/ton of phosphoric rock added as such.

The results of the flotation are shown in Table 1. The analyses of the % of $P_2O_5$ were obtained by means of X-ray fluorescence (XRF). Examples 1-4 are examples according to the invention, whereas examples C1-C4 are comparative examples.

Example 2

Foam Evaluation Tests

Method EN 14371 "Surface active agents. Determination of foamability and degree of foamability. Circulation test method" was used to evaluate the foam formation.

The method consists of making a solution of the collector in water with a certain hardness circulate for 10 minutes at a defined circulation speed. A defined foam volume characteristic of the collector is generated during this circulation at a certain concentration and temperature. After 10 minutes, the product reaches a saturation volume which is the maximum foaming power. After 10 minutes, the stirring is stopped and the foam destabilization and the time at which half the foam collapses, which indicates the stability of the foam formed by the collector, are recorded.

The foam volume of an aqueous solution of the collector to be tested was determined at a concentration of 120 ppm (active product), at a hardness of water of 20° HF (French degrees and at a temperature of 20° C. The circulation flow was 250 L/h. The maximum volume of the foam evaluation test tube was 1500 mL.

The results of the evaluation are shown in Table 1. Examples 1-4 are examples according to the invention, whereas examples C1-C4 are comparative examples.

TABLE 1

Evaluation of the collectors

| | Collector | | | Flotation | | | |
|---|---|---|---|---|---|---|---|
| | Phosphoric ester[3] | | | Recovery (%) | $P_2O_5$ | Foam | |
| | Chain ($R_2$) | Moles EO[1] (n) | Mono:Di[2] | Floated (is rejectted) | content (%) in the flotation concentrate | Max. Vol. (mL) | Max. Vol./2 (s) |
| 1 | $C_6$ | — | 50:50 | 30.1 | 32.00 | 100 | <30 |
| 2 | $C_6$ | — | 75:25 | 20.2 | 31.50 | 100 | <30 |
| 3 | $C_{8\text{-}iso}$ | 2.5 | 75:25 | 25.0 | 31.75 | 240 | <30 |
| 4 | $C_{10}$ | 3 | 75:25 | 16.8 | 31.07 | 440 | 210 |
| C1 | $C_{12}$-$C_{14}$[4] | 4 | 75:25 | 10.0 | 29.80 | >1500 | >600 |
| C2 | $C_{12}$-$C_{14}$[4] | 9 | 75:25 | 23.9 | 31.60 | >1500 | >600 |
| C3 | $C_{16}$-$C_{18}$[5] | 4 | 75:25 | 2.2 | — | >1500 | >600 |
| C4 | $C_{13\text{-}iso}$ | 6.5 | 75:25 | 27.8 | 32.50 | >1500 | >600 |

[1]Moles of ethylene oxide ($R_1$ = H)
[2]By weight ratio of monoester (k = 2) and diester (k = 1)
[3]In the phosphoric esters of Examples 1-4 and C1-C4, R3 is hydrogen.
[4]R2 comes from fatty alcohols obtained from coconut oil.
[5]R2 comes from fatty alcohols obtained from hydrogenated tallow Due to its deficient incorporation in water, the $P_2O_5$ content was not measured for comparative example C3.

The collectors according to the present invention have a good yield in the flotation tests ($P_2O_5$ content in the flotation concentrate greater than 30%) as well as a foam level (Max. Vol.) and a foam stability (Max. Vol. /2; time necessary for reducing the foam level by half) that are lower than the known collectors. The collectors according to the present invention which are alkoxylated are more suitable for reasons of incorporation in water.

The foam level and the stability of said foam obtained with the most suitable known collectors (comparative examples C2 and C4) are particularly unsuitable for an optimal flotation in a flotation plant in which water is recirculated.

Example 3

Flotation Tests at Different Collector Doses

Different flotation tests were carried out according to the procedure described in Example 1 at a collector dose of 340 g/ton of phosphoric rock added as such. The foam evaluation tests were likewise carried out according to Example 2. The results of the evaluation are shown in Table 2. Examples 3 and 5 are examples according to the invention, whereas Example C4 is a comparative example.

TABLE 2

Evaluation of the collectors

| | Collector | | | Flotation | | | |
|---|---|---|---|---|---|---|---|
| | Phosphoric ester[3] | | | Recovery (%) | $P_2O_5$ | Foam | |
| | Chain ($R_2$) | Moles EO[1] (n) | Mono:Di[2] | Floated (is rejectted) | content (%) in the flotation concentrate | Max. Vol. (mL) | Max. Vol./2 (s) |
| 3 | $C_{8\text{-}iso}$ | 2.5 | 75:25 | 20.3 | 30.90 | 140 | <30 |
| 5 | $C_{8\text{-}iso}$ | 2.5 | 60:40 | 15.7 | 30.20 | 180 | <30 |
| C1 | $C_{12}$-$C_{14}$[4] | 4 | 75:25 | 3.2 | 28.60 | >1500 | >600 |

[1]Moles of ethylene oxide ($R_1$ = H)
[2]By weight ratio of monoester (k = 2) and diester (k = 1)
[3]In the phosphoric esters of Examples 3, 5 and C1, R3 is hydrogen.
[4]R2 comes from fatty alcohols obtained from coconut oil.

The experimental results allow concluding that the collectors according to the invention are more efficient than the known collectors because they allow obtaining a greater recovery at smaller collector doses.

The invention claimed is:

1. A collector for the separation by flotation of carbonates contained in phosphoric rock, comprising a mixture of phosphoric monoester and diester of formula (I)

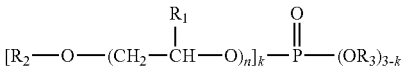

(I)

wherein, $R_1$ represents H, $CH_3$ or $C_2H_5$, $R_2$ represents, independently upon each occurrence, n-hexyl, 2-ethylbutyl, 2-methylpentyl, 2-ethylhexyl, or 2-methylheptyl, $R_3$ represents H or a suitable cation selected from the group consisting of an alkali metal, an alkaline earth metal, ammonium, alkyl ammonium, alkanol ammonium and glucammonium, k represents a number between 1 and 2, and n represents a number between 0 and 4, wherein in the mixture the by weight ratio between monoester and diester is between 90:10 and 50:50.

2. The collector according to claim 1, characterized in that in the phosphoric ester of formula (I) n represents a number between 0 and less than 4.

3. The collector according to claim 2, characterized in that in the phosphoric ester of formula (I) n represents a number between 0.5 and less than 4.

4. The collector according to claim 3, characterized in that in the phosphoric ester of formula (I) n represents a number between 1 and 3.5.

5. The collector according to claim 1, characterized in that in the phosphoric ester of formula (I) $R_3$ represents H or an alkali metal.

6. The collector according to claim 1, characterized in that it further comprises at least one cationic surfactant.

7. The collector according to claim 6, characterized in that the cationic surfactant is selected from the group consisting of optionally alkoxylated primary aliphatic amines; optionally alkoxylated linear or branched aliphatic polyamines; optionally alkoxylated aliphatic ether amines; and the water-soluble acid addition salts of these amines and/or ether amines.

8. The collector according to claim 7, wherein the optionally alkoxylated aliphatic ether amines are obtained from the reaction of an optionally alkoxylated alcohol and acrylonitrile and subsequent hydrogenation of the resulting nitrile ether.

9. The collector according to claim 6, characterized in that the cationic surfactant is selected from the group consisting of primary aliphatic amines; alkylene diamines substituted with alpha-branched alkyl moieties; hydroxy alkyl-substituted alkylene diamines; aliphatic ether amines and the water-soluble acid addition salts of these amines.

10. The collector according to claim 7, characterized in that in the water-soluble acid addition salts the acid is selected from the grou consisting of hydrochloric, phosphoric, nitric, sulfuric, acetic and formic acid, and mixtures thereof.

11. A process for the separation by flotation of carbonates contained in phosphoric rock, comprising mixing said ground phosphoric rock with water to form a suspension, introducing air to the suspension in the presence of the collector according to claim 1, and separating the foam formed together with the carbonates contained therein, the phosphates remaining as a flotation residue.

12. The process according to claim 11, characterized in that from 20 to 2000 g of the collector per ton of raw phosphoric rock are used.

13. The collector according to claim 1 wherein each occurrence of $R_2$ is independently 2-ethylbutyl, 2-methylpentyl, 2-ethylhexyl, or 2-methylheptyl.

14. The collector according to claims 8, characterized in that in the water-soluble acid addition salts the acid is hydrochloric, phosphoric, nitric, sulfuric, acetic, or formic acid, or a mixture thereof.

15. The collector according to claims 9, characterized in that in the water-soluble acid addition salts the acid is hydrochloric, phosphoric, nitric, sulfuric, acetic, or formic acid, or a mixture thereof.

16. The collector according to claim 4 wherein each occurrence of $R_2$ is independently 2-ethylbutyl, 2-methylpentyl, 2-ethylhexyl, or 2-methylheptyl.

17. The collector according to claim 14 wherein each occurrence of $R_2$ is independently 2-ethylbutyl, 2-methylpentyl, 2-ethylhexyl, or 2-methylheptyl.

18. The collector according to claim 15 wherein each occurrence of $R_2$ is independently 2-ethylbutyl, 2-methylpentyl, 2-ethylhexyl, or 2-methylheptyl.

* * * * *

UNITED STATES PATENT AND TRADEMARK OFFICE

CERTIFICATE OF CORRECTION

PATENT NO. : 8,657,118 B2
APPLICATION NO. : 12/312842
DATED : February 25, 2014
INVENTOR(S) : Fajardo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1187 days.

Signed and Sealed this
Twenty-ninth Day of September, 2015

Michelle K. Lee

Michelle K. Lee
*Director of the United States Patent and Trademark Office*